US005172840A

United States Patent [19]

Bloch et al.

[11] Patent Number: 5,172,840

[45] Date of Patent: Dec. 22, 1992

[54] DISPENSING APPARATUS FOR PRIMARY AND REMNANT ROLLS OF TOILET TISSUE

[76] Inventors: Nathan D. Bloch, 16 N. Green Acre Dr., Cherry Hill, N.J. 08003; Edward J. O'Brien, 8 Oxford Ct., Eastampton, N.J. 08060; W. Scott Reitze, 704 Meadowwood La., Media, Pa. 19063

[21] Appl. No.: 795,229

[22] Filed: Nov. 15, 1991

Related U.S. Application Data

[63] Continuation of Ser. No. 730,385, Jul. 15, 1991, abandoned, which is a continuation of Ser. No. 495,803, Mar. 19, 1990, abandoned.

[51] Int. Cl.[5] ..... A47K 10/32

[52] U.S. Cl. ..... 225/37; 225/34; 225/43

[58] Field of Search ..... 225/34, 37, 38, 43; 83/660, 650; 242/55.3, 55.53

[56] References Cited

U.S. PATENT DOCUMENTS

| | | | |
|---|---|---|---|
| 1.423,336 | 7/1922 | Korittke . | |
| 1,975,414 | 10/1934 | Wade . | |
| 3.650,487 | 3/1972 | Bahnsen . | |
| 3,700,181 | 10/1972 | Diring et al. . | |
| 4,142,431 | 3/1979 | Jespersen | 83/660 |
| 4,206,858 | 6/1980 | DeLuca et al. | 83/660 |
| 4,317,547 | 3/1982 | Graham, Jr. et al. . | |
| 4,422,584 | 12/1983 | Dashnier et al. . | |
| 4,706,904 | 11/1987 | Raymond . | |
| 4,739,943 | 4/1988 | Geller . | |
| 4,796,832 | 1/1989 | Schutz et al. . | |
| 4,846,412 | 7/1989 | Morand | 225/91 |
| 4,872,601 | 10/1989 | Sigmund | 225/38 |

FOREIGN PATENT DOCUMENTS

| | | | |
|---|---|---|---|
| 2627071 | 8/1989 | France | 242/55.3 |

*Primary Examiner*—Hien H. Phan

*Attorney, Agent, or Firm*—Mark G. Bocchetti; John W. Kane, Jr.

[57] ABSTRACT

A dispenser for toilet tissue comprises a housing in which are disposed parallel primary and secondary spindles adapted to carry primary and remnant rolls of tissue. The secondary spindle is located below the primary spindle and is spaced horizontally from a vertical centerline of the housing. The secondary spindle is slidably mounted in inclined slots, so that the stub roll, as it is depleted, gradually gravitates away from the vertical centerline, or alternatively the secondary spindle is pivotably mounted to the housing.

20 Claims, 5 Drawing Sheets

Fig. 9
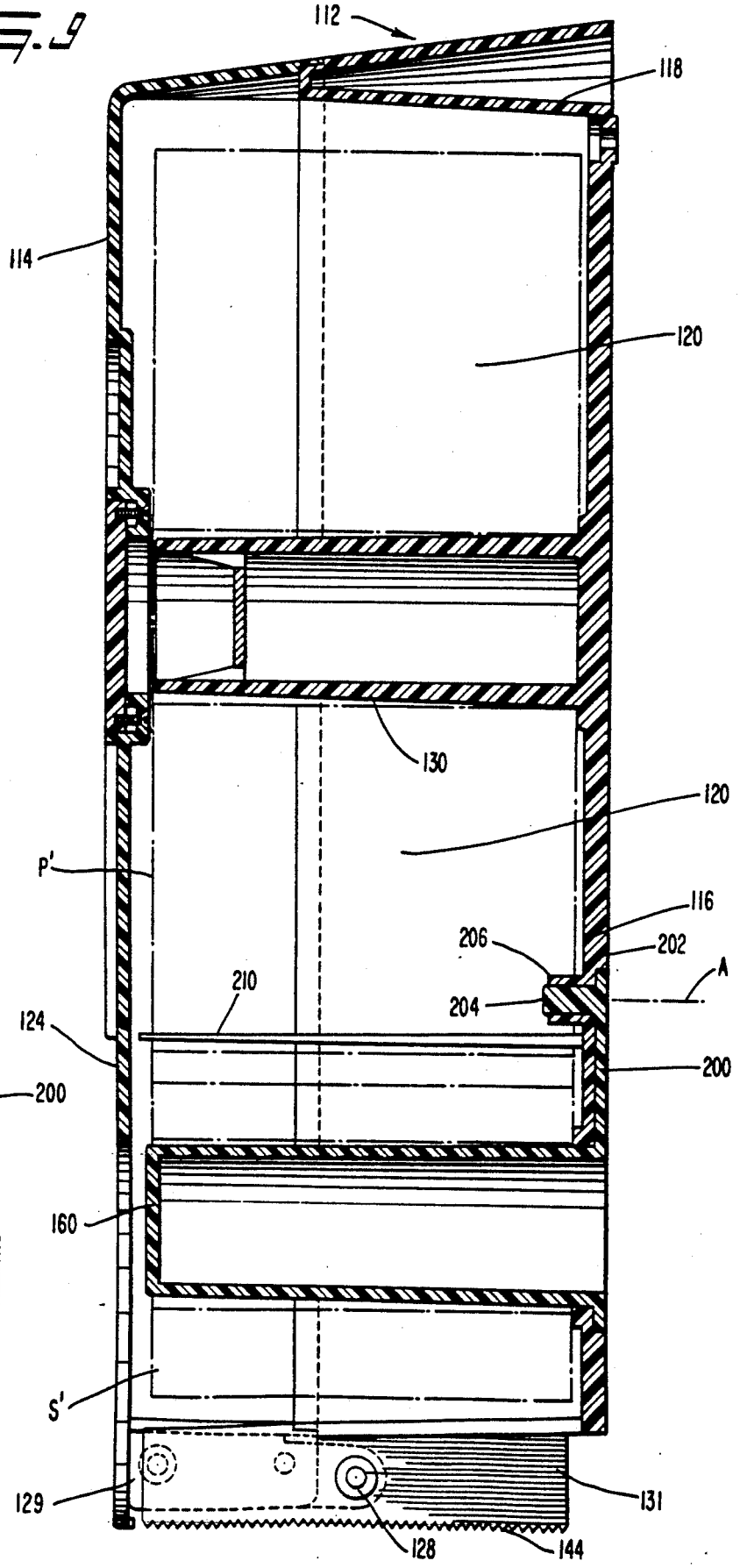
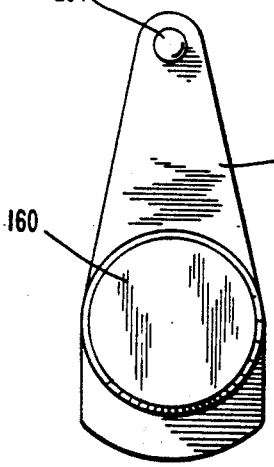
Fig. 10

DISPENSING APPARATUS FOR PRIMARY AND REMNANT ROLLS OF TOILET TISSUE

This application is a continuation of application Ser. No. 07/730,385, filed Jul. 15, 1991, now abandoned which is a continuation of application Ser. No. 07/495,803, filed Mar. 19, 1990, now abandoned.

BACKGROUND OF THE INVENTION

The present invention relates to a dispenser for rolls of toilet tissue, and in particular to such a dispenser which simultaneously houses a primary tissue roll and a remnant tissue roll or stub roll.

Toilet tissue dispensers are known which dispense rolls of toilet tissue, such as oversized or jumbo rolls for example. Dispensers of this nature are commonly provided in commercial establishments in order to minimize the frequency of roll replacement. Although the replacement interval is extended, there remains the problem of how to best utilize a substantially spent roll, commonly referred to as a stub or remnant roll, in order to minimize waste.

It has been previously proposed, for example, to provide the dispenser with an auxiliary spindle outside of the main housing onto which the stub roll can be placed (see Schultz et al. U.S. Pat. No. 4,796,832). The auxiliary spindle is disposed parallel with the main spindle and spaced horizontally therefrom, whereby the stub roll is uncovered. A bar extends from the main housing to a front end of the auxiliary spindle to prevent the stub roll from being removed unless the main housing has been unlocked and opened.

Such an arrangement suffers from certain drawbacks. For example, the exposed stub roll is not covered by the housing and is susceptible to possible contamination. Also, since the auxiliary spindle is spaced to one side of the main housing, a certain amount of mounting versatility is sacrificed. That is, the dispenser is not useful unless the auxiliary spindle extends toward the user's station; otherwise, the stub roll would be too remote to be conveniently reached. Therefore, it would be necessary to modify the dispenser in order to adapt it for use with stations disposed to both sides of the dispenser.

SUMMARY OF THE INVENTION

In accordance with the present invention, a toilet tissue dispenser is provided with a housing including front and rear walls which define a chamber therebetween. The chamber includes a tissue removal opening at a bottom portion thereof as well as an openable cover to afford access to the chamber. A primary spindle disposed within the chamber extends in a front-to-rear horizontal direction and is adapted to carry a primary roll of toilet tissue. A secondary spindle is disposed in the chamber at a location below the primary spindle. The secondary spindle is parallel to the primary spindle and is adapted to carry a stub roll of toilet tissue of smaller diameter than the primary roll. The secondary spindle is adapted for automatic sideward movement away from a vertical center line of the housing in response to stub roll depletion to facilitate access to the primary roll when the stub roll is depleted.

Preferably, the secondary spindle is mounted for gravitational movement in a direction downwardly and away from the center line.

Preferably, the secondary spindle is pivotably mounted to the rear wall by a generally front-to-rear extending horizontal pivot. Alternatively, the secondary spindle includes front and rear slots formed in the front and rear walls, respectively, of the housing. The slots are mutually parallel and are inclined relative to horizontal.

The housing preferably includes baffle structure disposed beneath the primary spindle and extending toward the center line for locating a tail of the primary roll in horizontally spaced relationship relative to serrated cutting edges of the housing. This baffle structure further prevents the primary roll tail from falling behind the stub roll spindle.

It is preferred that the housing include a reference mark indicating a maximum radius of a depleted primary roll which can be used as a stub roll.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which:

FIG. 9 is a sectional view taken through the base along the line 9—9 in FIG. 7, with the cover in place, and with the primary tissue roll and stub roll shown in phantom;

FIG. 10 is a front view of a secondary spindle element according to the embodiment of the present invention depicted in FIG. 7.

DETAILED DESCRIPTION OF PREFERRED EMBODIMENTS OF THE INVENTION

Figure 1:
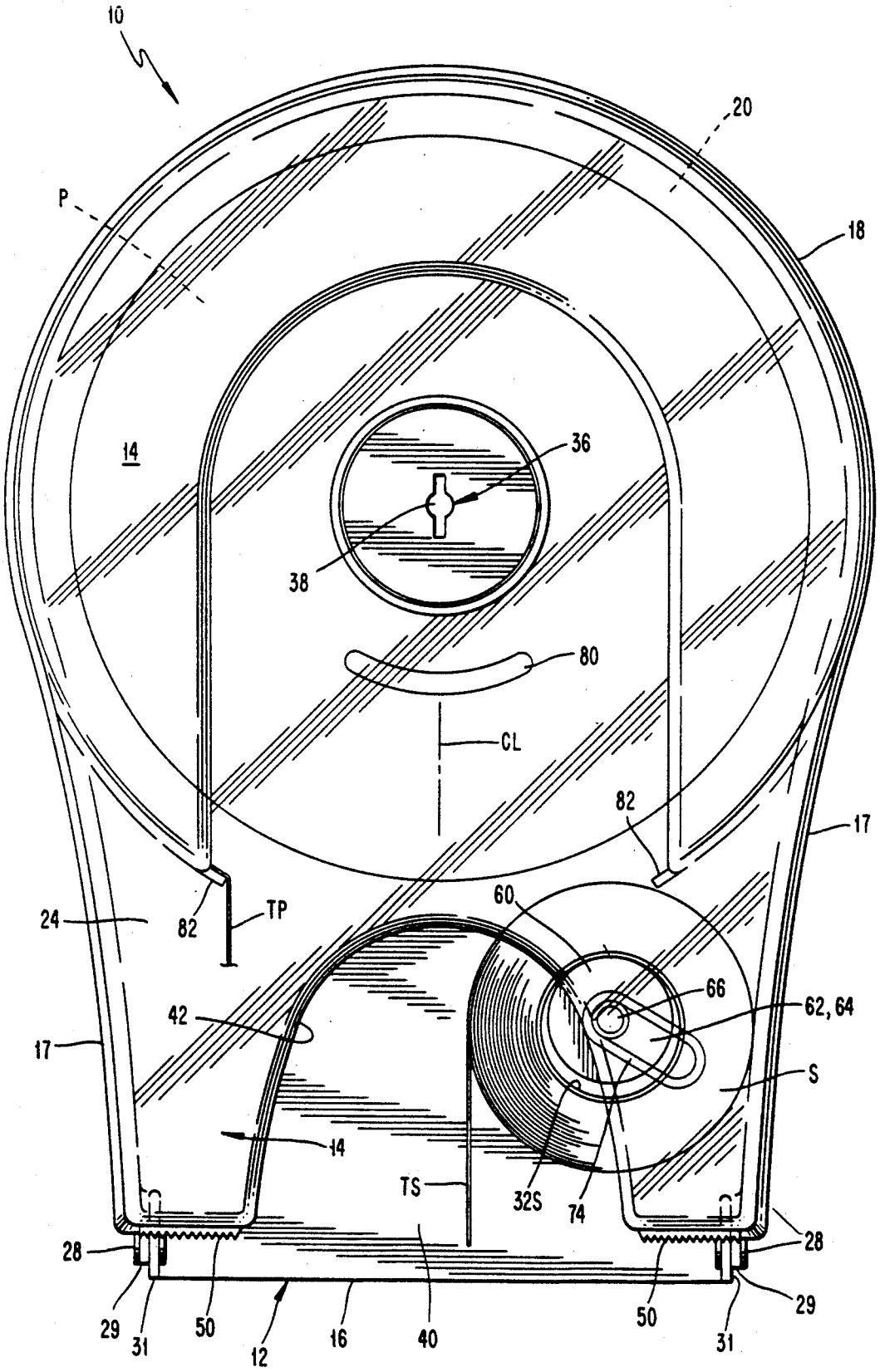
FIG. 1 is a front elevational view of a toilet tissue dispenser according to a first embodiment of the present invention, with both a primary roll and stub roll mounted therein.
Figure 2:
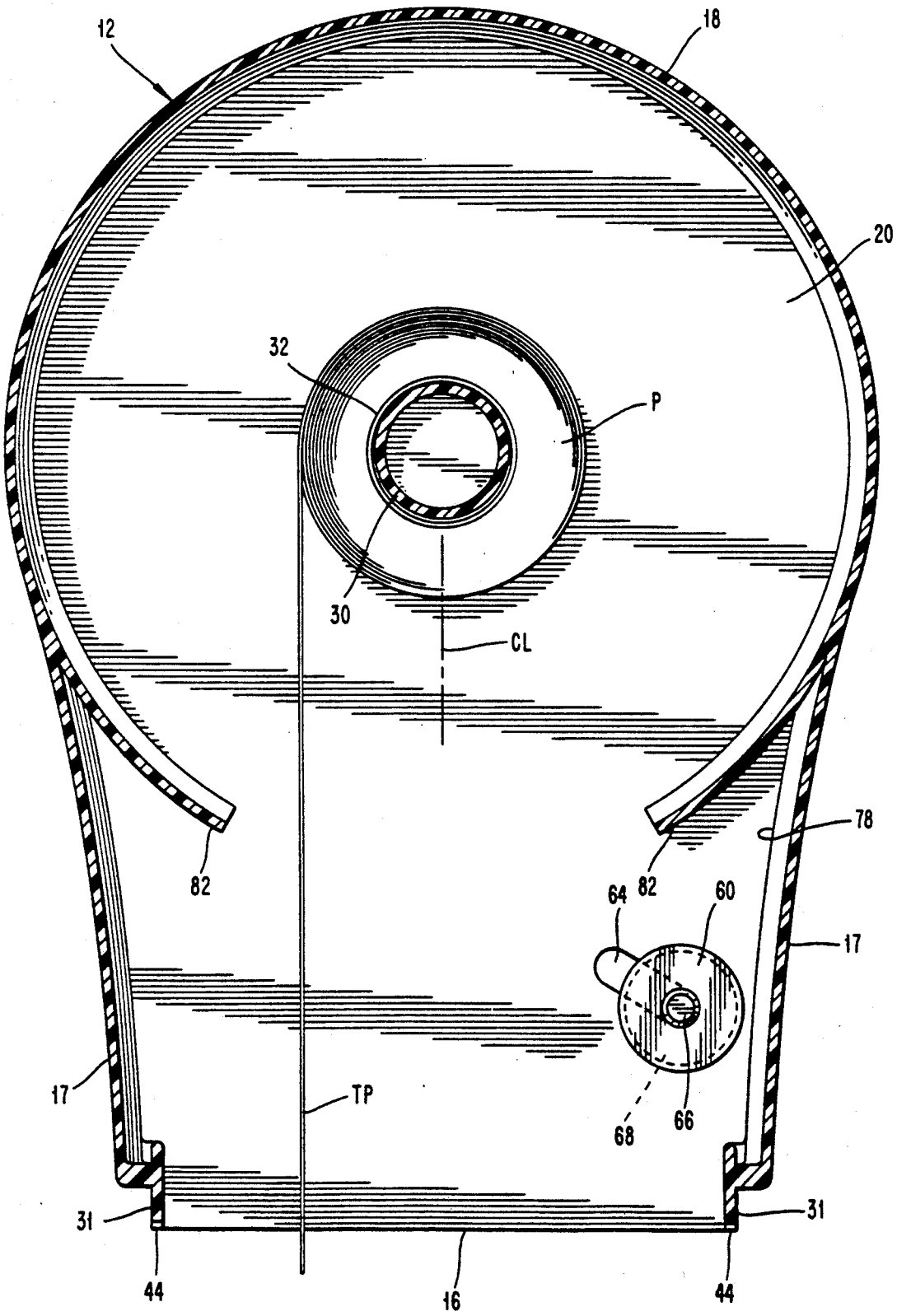
FIG. 2 is a front elevational view of a base portion of the dispenser with a cover thereof removed, and with the stub roll position being vacant, and the primary roll being depleted to such an extent that it is suitable for use as a stub roll.
Figure 3:
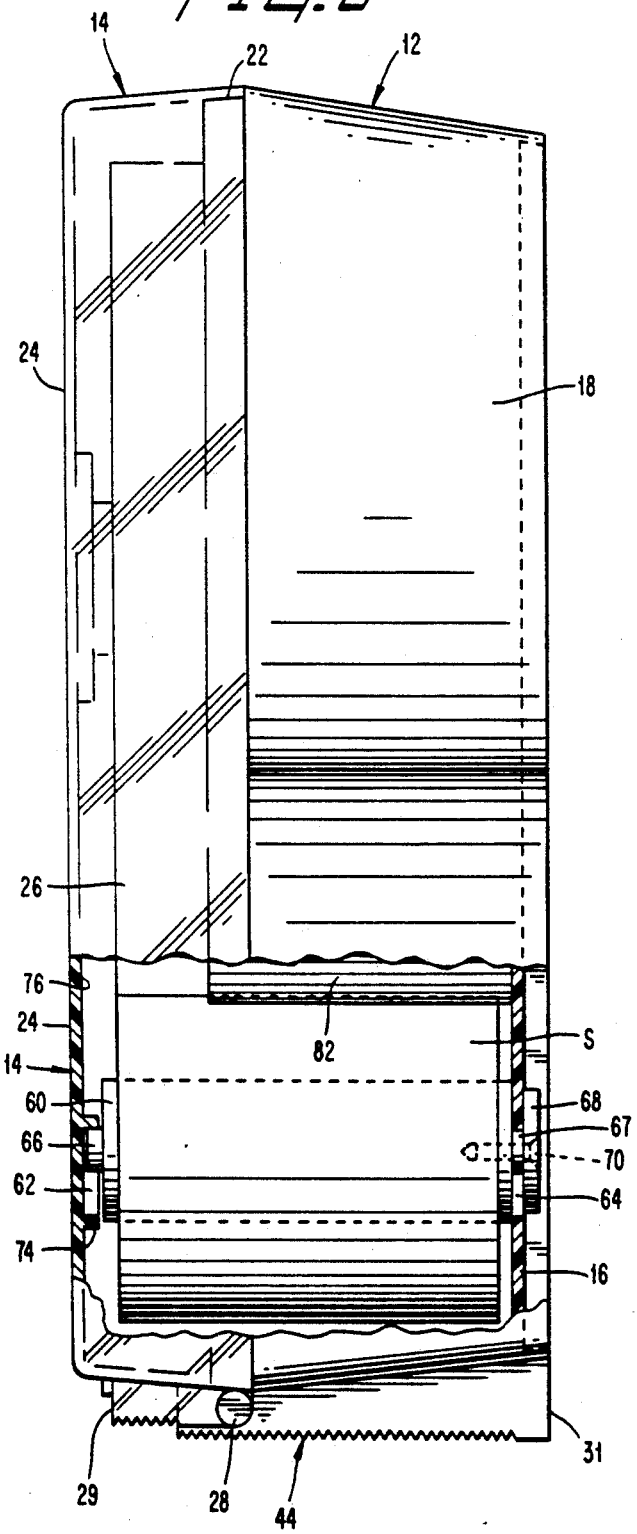
FIG. 3 is a side elevational view of the dispenser, with a portion thereof broken away to expose the stub roll.
Figure 4:
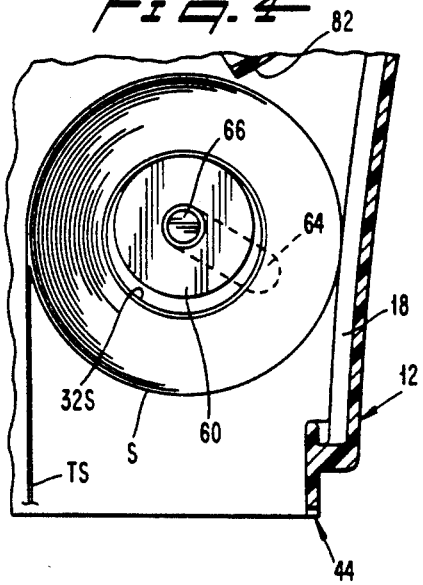
FIGS. 4, 5, and 6 are fragmentary front elevational views of the stub roll in various stages of depletion, with FIG. 6 showing the secondary spindle after the paper on the stub roll has been fully depleted.
Figure 5:
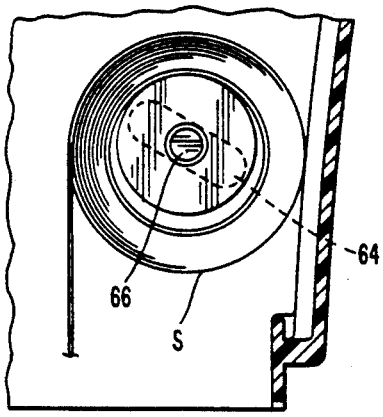
Figure 6:
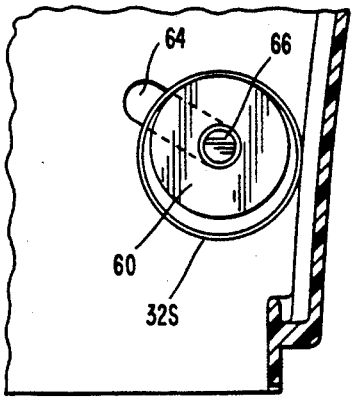

A toilet tissue roll dispenser 10 according to a first preferred embodiment of the present invention comprises a rear housing 12 and an openable cover section 14 (see FIGS. 1–6). The rear housing 12 includes a rear wall 16, side walls 17 and top wall 18. Sidewall 17 and top wall 18 extend forwardly from rear wall 16. Side walls 17 and top wall 18 form what is substantially an inverted U-shape which is somewhat bulbous at the top. Extending from top wall 18 and sidewalls 17 is lip 22. (See FIG. 3) The cover section 14, which is preferably formed of a transparent plastic material, includes a front wall 24 and a sidewall 26. Sidewall 26 extends rearwardly from front wall 24 to substantially abut and mate with lip 22 when cover section 14 is closed on rear housing 12.

Extending downwardly from cover section 14 are brackets 29. Extending downwardly from rear housing 12 are brackets 31. The cover section 14 is pivotally connected to the rear housing 12 by pins 28 mounted through brackets 29 and 31.

Projecting perpendicularly forwardly from rear wall 16 is a hollow primary spindle 30 which is adapted to receive the core 32 of a primary roll P of toilet tissue, preferably in the form of an oversize or jumbo roll. Top wall 18 is of curved configuration in conformance with the diameter of the primary roll P in order to contain the roll P in a space-efficient manner.

A conventional locking mechanism 36 is mounted on the cover section 14 and includes a rotary locking post (not shown) which is adapted to fit telescopingly into the primary spindle 30 and engage a locking shoulder formed therein. Upon rotation of the post, preferably by means of a key inserted into a keyhole 38 extending through the front wall 24, the cover section 14 will become locked to the rear housing 12.

Access to the primary roll P is afforded through an access opening 40 defined by an open lower portion of the chamber 20. The access opening 40 is enlarged by a mousehole-shaped cut-out 42. Cut-out 42 allows easier access to the tail of primary roll P.

Situated at the sides of the access opening 40 are serrated cutting edges 44 which facilitates tearing of the tissue. Serrated cutting edges 44 are formed on the lower edges of brackets 29 and 31. Additional serrated cutting edges 50 are also formed at the lower ends of front wall 24.

In accordance with the present invention there is provided a secondary spindle 60 for receiving a partially depleted primary roll, hereinafter termed a stub roll S. The secondary spindle 60 is oriented within the chamber 20 parallel to the primary spindle 30 at a location below the primary roll P and with its cylindrical axis slightly horizontally offset toward the side wall 17 relative to the primary spindle 30.

The secondary spindle is slidably mounted in front and rear slots 62, 64 formed in the front wall 24 and rear wall 16, respectively. The secondary spindle 60 includes a forwardly projecting journal 66, slidably disposed in the front slot 62, and a rearwardly projecting journal 67 slidably disposed in the rear slot 64. A washer 68 is attached to a rear end of the rear journal 67 by means of a screw 70. The diameter of the washer 68 is larger than the width of the rear slot 64. Washer 68 resides behind rear wall 16. Washer 68 only loosely contacts the rear wall 16, whereby the secondary spindle is free to slide in the slots 62, 64.

The front slot 62 does not extend completely through the front wall 24, but rather comprises an oblong lip 74 which projects inwardly from front wall 24.

The front and rear slots 62, 64 are parallel and inclined relative to horizontal such that the slots descend in a direction away from a vertical centerline CL of the dispenser, preferably at about a sixty degree angle to that centerline. The secondary spindle 60 is freely slidable within the slots 62, 64 and is thus able to gravitate downwardly and away from the centerline CL in a gradual manner as the stub roll S is depleted. That is, the stub roll S will gravitate toward the adjacent side wall 17 of the dispenser until stopped in response to engagement of the outer periphery of the stub roll with side wall 17 (see FIG. 4).

The maximum diameter of the stub roll S is such that one side of the stub roll, i.e., a side located proximate the centerline CL, is visible through the mousehole-opening 42 in the front wall 24. A proper sizing of the stub roll diameter is ensured by the provision of a reference mark 80 on the front wall 24 (FIG. 1) situated at a location corresponding to the desired maximum radius of the stub roll. Hence, when the primary roll P has been depleted to the extent that its outer diameter is situated at or inside of the reference mark 80, the maintenance personnel know that the partially depleted primary roll P can be transferred to the secondary spindle 60 as a stub roll S and replaced by a new primary roll P. The reference mark 80 can be formed in any desired manner, such as by forming a recess in the inner surface 76 of a transparent front wall 24 with the recess being discernable through the front of the cover.

The tail TS of the stub roll S is able to hang downwardly through the access opening 40 to be easily gripped by a user located at a station situated to either side of the dispenser. In the event that the tail TS does not project sufficiently far downwardly, requiring that the user reach into the access opening, it will be appreciated that the stub roll is so situated as to effectively block access to the primary roll P. As the stub roll S becomes depleted, it gradually gravitates downwardly away from the centerline CL (see FIGS. 5 and 6) in a manner gradually increasing access to the primary roll P. Thus, by the time that the stub roll S has been fully depleted, the secondary spindle will be moved sufficiently sidewards to provide essentially unobstructed access to the primary roll P.

There are a pair of baffles 82 located in rear housing 12. Baffles 82 are perpendicular to rear wall 16 and extend inwardly from sidewalls 17. Preferably, baffles 82 are arcuate with radii equal to the radius of top wall 18. Baffles 82 are located between the primary roll P and stub roll S and assure that the tail TP of the primary roll P hangs in horizontally spaced relationship relative to the side walls 17 (see FIG. 1). This makes it less likely that the user will touch (and possibly contaminate) the cutting edges 44 when reaching for the tail TP of the primary roll. Since there are two baffles 82, this advantage is achieved regardless of whether the tail TP hangs from the right or left side of the primary roll P. Baffles 82 further ensure that tail TS will not fall behind or become trapped behind stub roll S.

It will be appreciated that the dispenser according to the first embodiment of the present invention accommodates both a primary roll P and a stub roll S conveniently within a common chamber 20, such that the dispenser is adapted to service a user station situated in either side of the dispenser. Since the ends of the secondary spindle 60 are mounted in the cover and base, respectively, removal of the stub roll S is not possible unless the cover section 14 has been opened, thereby discouraging pilfering by users. Furthermore, since the stub roll S is essentially shielded within the housing, contamination thereof as the result of handling by users is less likely to occur. As the secondary spindle 60 and the core 32S of the stub roll gravitate downwardly and away from the dispenser centerline CL (as the stub roll is depleted), essentially unobstructed access to the primary roll will be automatically provided once the stub roll S has been fully depleted.

Figures 7, 8:
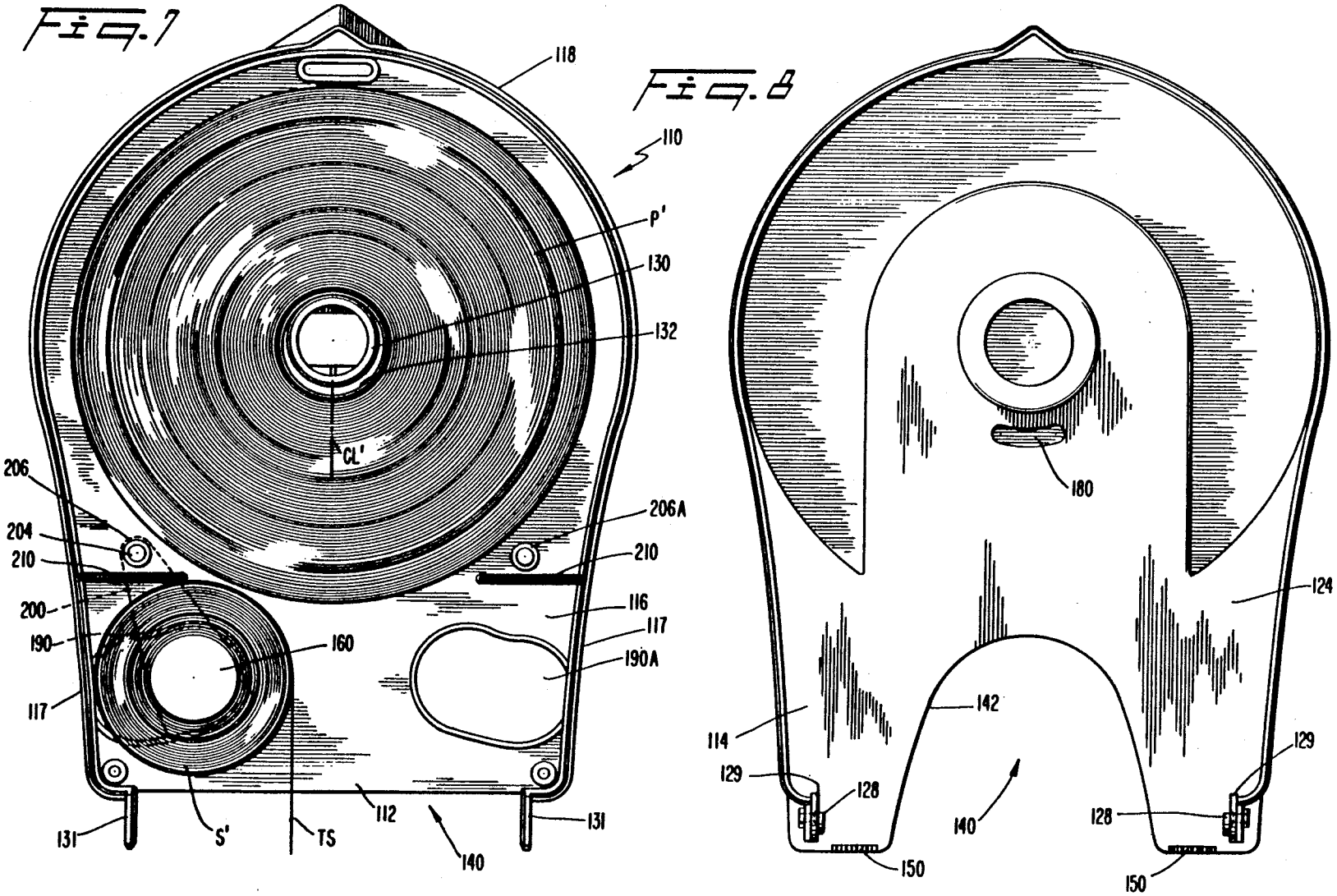
FIG. 7 is a front elevational view through a base of a second embodiment of the present invention, with the cover removed.
FIG. 8 is a rear elevational view of a cover adapted to be mounted to the base depicted in FIG. 7.

A second preferred embodiment is disclosed in connection with FIGS. 7-10. In that embodiment, the dispenser 110 formed by a rear housing 112 and an openable cover section 114 which define an internal chamber 120. The rear housing 112 includes rear wall 116, top wall 118, and concave sidewalls 117. Top wall 118 is an arcuate member and may be generally cylindrical in nature, or, as shown more clearly in FIG. 9, may be tapered to form a substantially truncated conical member.

A pair of brackets 129 extend down from cover section 114. A pair brackets 131 extend down from rear housing 112, brackets 129 pivotally connect to brackets 131 by means of pins 128.

Projecting perpendicularly forwardly from rear wall 116 is a hollow primary spindle 130 which is adapted to support the core 132 of a primary roll P' of toilet tissue. A conventional locking mechanism can be mounted on the cover for insertion into the primary spindle 130 when the cover section 114 is closed.

Access to the primary roll P' by a user is afforded through an access opening 140 defined by an open lower portion of the chamber, which opening 140 is enlarged by a mousehole-shaped cut-out 142 in the cover section 114. Situated at the sides of the access opening are serrated cutting teeth formed on the bottom edges of brackets 129 and 131, and on bottom edges 150 of front wall 124.

A secondary spindle 160 is provided for receiving a partially depleted primary roll, hereinafter termed a stub roll S'. The secondary spindle 160 is oriented within the chamber 120 parallel to the primary spindle 130 at a location below the primary roll P' and horizontally offset away from a centerline CL' of the housing.

A rear portion of the secondary spindle 160 projects through and is slidably mounted in a slotted aperture 190 formed in the rear wall 116, and is pivotably mounted to the rear housing 112 by means of a hanger plate 200 which is rigidly joined to the secondary spindle 160 (see FIG. 10). The hanger plate 200 extends upwardly from a rear end of the secondary spindle 160 behind rear wall 116. Installation and removal of the secondary spindle 160 is thus possible only through the rear wall of the base. The hanger plate 200 is freely pivotably mounted to that rear wall 116 by means of a pin 204 which projects forwardly from the hanger plate and is rotatably supported within a cylindrical projection 206 formed in the rear wall 116. It will be appreciated that the secondary spindle is free to rotate about an axis of rotation A of the pin 204 within the confines of the slotted aperture 190. The pin 204 is loosely disposed in the projection 206 and is retained in the projection since the hanger plate will be sandwiched between the rear wall 116 of the dispenser and the wall of the room in which the dispenser is hung.

The axis A is offset horizontally relative to a position occupied by the axis of the secondary spindle when the latter carries a stub roll S', the offset being such that the axis A is disposed closer to the sidewall 117 than the axis of the secondary spindle when the latter carries a stub roll. Thus, the secondary spindle 160 will tend to gravitate toward an end of the slot located remotely from centerline CL'. The slotted aperture 190 is inclined slightly downwardly away from the centerline CL' to accommodate the arcuate movement of the secondary spindle 160.

Consequently, when a stub roll S' is mounted on the secondary spindle 160, spindle 160 will be held away from the sidewall 117 as the result of contact between the stub roll S' and that sidewall 117. As the stub roll S' is gradually depleted, the stub roll S' will gravitate toward the sidewall 117.

The maximum diameter of the stub roll S' is such that one side of the stub roll, i.e., a side located proximate the centerline CL' is visible through the mousehole-opening 142. A proper sizing of the stub roll diameter is ensured by the provision of a reference mark 180 on a front wall 124 of the cover 114. The mark 180 is situated at a location corresponding to the desired maximum radius of the stub roll governed by the distance which secondary spindle 160 can be rotated from sidewall 117 in slotted aperture 190.

The tail TS of the stub roll S' is able to hang downwardly through the access opening 140 to be easily gripped by a user located at a station situated to either side of the dispenser. In the event that the tail TS is too short, requiring that the user reach into the access opening, it will be appreciated that the stub roll S' is so situated as to effectively block access to the primary roll P' Thus, the user will grip the tail TS of the stub roll S'. As the stub roll S' becomes depleted, it gradually gravitates downwardly away from the centerline CL' in a manner gradually increasing access to the primary roll P'. Thus, by the time that the stub roll S' has been fully depleted, the secondary spindle 160 will be moved sufficiently sidewards to provide essentially unobstructed access to the primary roll P'.

There is provided a second slotted aperture 190A and a second projection 206A on an opposite side of the centerline CL' from the first slotted aperture 190, enabling the secondary spindle 160 to be mounted on either side of the dispenser. The dispenser 110 can thus be assembled to service a user station disposed on either side thereof.

Formed in the rear housing 112 are baffles 210 extending horizontally toward the centerline CL. The baffles 210 are located between the primary roll P' and the stub roll S' and assure that the tail of the primary roll P' hangs in horizontally spaced relationship relative to the sidewalls 117. This makes it less likely that the user will touch (and possibly contaminate) the serrated cutting edges 144, 150 when reaching for the tail of the primary roll. Since there are two baffles 210, this advantage is achieved regardless of whether the tail hangs from the right or left side of the primary roll P'.

It will be appreciated that the dispenser 110 according to the second embodiment of the present invention accommodates both a primary roll P' and a stub roll S' conveniently within a common chamber, such that the dispenser is adapted to service a user station situated on either side of the dispenser. Like the primary roll P', the stub roll S' can be removed from dispenser 110 only by opening locked cover section 114. The present invention therefore discourages pilfering of both the primary and stub rolls.

Furthermore, since the stub roll S' is essentially shielded within the housing, contamination thereof as the result of handling by users is less likely to occur. As the secondary spindle 160 and the core of the stub roll gravitate downwardly and away from the dispenser centerline CL' (as the stub roll S' is depleted), essentially unobstructed access to the primary roll P' will be automatically provided once the stub roll S' has been fully depleted.

In summary, in accordance with the present invention the stub roll is shielded by the dispenser housing so as to be less susceptible to contamination. The stub is so situated in the dispenser such that the tail thereof is accessible to user stations disposed on either side of the dispenser. Further, the secondary spindle automatically assumes an out-of-the-way position once the stub roll has been depleted, so that full access to the primary roll is afforded. Until then, the stub roll somewhat obstructs access to the primary roll to reduce chances for users to deplete the primary roll rather than the stub roll. The baffles located beneath the primary roll assure that the tail of the primary roll is spaced from the serrated cutting edge so as to minimize the possibility that the user will touch those edges when reaching for the tissue.

Although the present invention has been described in connection with a preferred embodiment thereof, it will be appreciated by those skilled in the art that additions, substitutions, modifications, and deletions, not specifically described may be made without departing from the spirit and scope of the invention as defined in the appended claims.

What is claimed is:

1. A toilet tissue dispenser comprising:

(a) a rear housing including a rear wall for attachment to a supporting surface;

(b) a cover, being closeable on said rear housing to define a chamber including sidewalls for enclosing a roll of toilet tissue, said chamber having an opening at the bottom thereof sufficient to allow manual access to the roll;

(c) a primary spindle projecting perpendicularly from said rear wall at a fixed position within said chamber for supporting the roll of toilet tissue;

(d) a secondary spindle within said chamber, said secondary spindle located below said primary spindle and being parallel to said primary spindle, said secondary spindle being further adapted for automatic movement away from a vertical center line of said chamber and toward one or said sidewalls as said stub is depleted thereby facilitating access to said primary roll when said stub roll is fully depleted, said secondary spindle including front and rear journals mounted for sliding movement in front and rear slots in said cover and said rear housing, respectively.

2. A toilet tissue dispenser according to claim 1, wherein said secondary spindle is mounted for gravitational movement in a direction downwardly and away from said centerline.

3. A toilet tissue dispenser according to claim 2, wherein: said slots are mutually parallel and inclined relative to horizontal.

4. A toilet tissue dispenser according to claim 1, wherein the axis of rotation of said secondary spindle is disposed below said primary spindle and horizontally spaced from said centerline.

5. A toilet tissue dispenser according to claim 1 including a cut-out in a front wall of said cover to allow easier access said rolls of tissue.

6. A toilet tissue dispenser according to claim 1, further comprising:

brackets extending downward from said rear housing, said brackets including serrated cutting edges at their lower edges; and baffle means within said rear housing disposed beneath said primary spindle and extending toward said centerline for locating a tail of the primary roll in horizontally spaced relationship relative to said serrated cutting edges.

7. A toilet tissue dispenser according to claim 1 further comprising:

baffle means within said chamber below said primary spindle and extending toward said vertical centerline for positioning a tail of said primary roll toward the center of said opening.

8. A toilet tissue dispenser according to claims 7, wherein said baffle means comprises first and second baffles disposed on opposite sides of said centerline, one of said baffles disposed between said primary and secondary spindles.

9. A toilet tissue dispenser according to claim 1 further including a reference mark on said cover indicating a maximum radius of a depleted primary roll which can be used as a stub roll.

10. A toilet tissue dispenser according to claim 9, wherein said reference mark is defined by a recess formed in a transparent portion of said cover.

11. A toilet tissue dispenser according to claim 1 including a serrated cutting edge along portions of said opening.

12. A toilet tissue dispenser comprising:

(a) a rear housing including a rear wall for attachment to a supporting surface;

(b) a cover, being closeable on said rear housing to define a chamber including sidewalls for enclosing a roll of toilet tissue, said chamber having an opening at the bottom thereof sufficient to allow manual access to the roll;

(c) a primary spindle projecting perpendicularly from said rear wall at a fixed position within said chamber for supporting the roll of toilet tissue;

(d) a secondary spindle within said chamber, said secondary spindle located below said primary spindle and being parallel to said primary spindle, said secondary spindle adapted to support a stub roll;

(e) a slotted aperture in said rear wall, said secondary spindle projecting rearwardly through said slotted aperture;

(f) a hanger plate extending upwardly from said secondary spindle, said hanger plate being pivotally mounted to said rear wall to define an axis of rotation for said hanger plate and said secondary spindle, so that said secondary spindle is adapted for automatic movement away from a vertical center line of said chamber and toward one of said sidewalls as said stub is depleted, said hanger plate located outside of said chamber.

13. A toilet tissue dispenser according to claim 12, wherein said axis is offset horizontally relative to a cylindrical axis of said secondary spindle when the latter carries a stub roll such that said secondary spindle gravitates away from said primary spindle during depletion of the stub roll.

14. A toilet tissue dispenser accordingly to claim 12, wherein said axis of rotation is disposed below said primary spindle and horizontally spaced from said centerline.

15. A toilet tissue dispenser comprising:

(a) a rear housing including a rear wall for attachment to a supporting surface;

(b) a cover closeable on said rear housing to define a chamber for enclosing a roll of toilet tissue, said chamber having a tissue removal opening at the bottom thereof sufficient for manual access to said roll of toilet tissue;

(c) a primary spindle disposed within said chamber projecting perpendicularly from said rear wall at a fixed location and adapted to carry a primary roll of toilet tissue;

(d) a secondary spindle disposed in said chamber at a location below and horizontally offset from said primary spindle, said secondary spindle disposed parallel to said primary spindle and adapted to carry a stub roll of toilet tissue of smaller diameter than the primary roll, said second spindle extending through a slotter aperture in said rear wall and connected to a hanger residing outside of said chamber, said hanger pivotally connected to said rear wall above said slotter aperture thereby allowing said secondary spindle to move by gravity in a direction downwardly away from a vertical centerline of said chamber as the stub roll is gradually depleted, said secondary spindle and said stub roll substantially blocking manual access to said primary roll until said stub roll has been substantially depleted.

16. A toilet tissue dispenser according to claim 15, wherein said cover is pivotably connected to said rear housing.

17. A toilet tissue dispenser according to claim 15 further including a cut-out in said cover affording easier access to a tail of said tissue.

18. A toilet tissue dispenser according to claim 15, further comprising:

brackets extending downward from said rear housing, said brackets including serrated cutting edges at the lower edges thereof;

baffle means within said rear housing disposed beneath said primary spindle and extending toward said centerline for locating a tail of the primary roll in horizontally spaced relationship relative to said serrated cutting edges.

19. A toilet tissue dispenser according to claim 18, wherein said baffle means comprises first and second baffles disposed on opposite sides of said centerline, one of said baffle means disposed between said primary and secondary spindles.

20. A toilet tissue dispenser according to claim 15 further including a reference mark on said cover indicating a maximum radius of a depleted primary roll which can be used as a stub roll.

* * * * *